US007084866B2

(12) United States Patent
Kobayashi

(10) Patent No.: US 7,084,866 B2
(45) Date of Patent: Aug. 1, 2006

(54) DISPLAY DRIVER APPARATUS, AND ELECTRO-OPTICAL DEVICE AND ELECTRONIC EQUIPMENT USING THE SAME

(75) Inventor: Kazuo Kobayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 10/005,494

(22) Filed: Nov. 6, 2001

(65) Prior Publication Data

US 2002/0107588 A1 Aug. 8, 2002

(30) Foreign Application Priority Data

Nov. 13, 2000 (JP) ..... 2000-344852

(51) Int. Cl.
*G09G 5/00* (2006.01)

(52) U.S. Cl. ..... 345/214; 345/89; 345/99

(58) Field of Classification Search ..... 345/50, 345/55, 204, 213, 214, 691–692, 84–109, 345/561, 567, 673
See application file for complete search history.

(56) References Cited

U.S. PATENT DOCUMENTS 5,576,737 A * 11/1996 Isozaki ..... 345/211
5,953,002 A * 9/1999 Hirai et al. ..... 345/204
6,040,826 A * 3/2000 Furukawa ..... 345/534
6,538,629 B1 3/2003 Ito
2002/0011994 A1 * 1/2002 Imamura ..... 345/204

FOREIGN PATENT DOCUMENTS

JP 11149278 * 6/1999
WO WO97/43750 * 11/1997
WO WO 00/02185 1/2000

* cited by examiner

*Primary Examiner*—Amr A. Awad
*Assistant Examiner*—Leonid Shapiro
(74) *Attorney, Agent, or Firm*—Michael T. Gabrik

(57) ABSTRACT

A display driver capable of operating in any one of multiple gradient display modes drives a liquid crystal panel in which the first L common electrodes are simultaneously selected in a first selection period and successive groups of L common electrodes are simultaneously selected in successive selection periods. 8-bit display data for each segment electrode are simultaneously read from a display data RAM and latched. First and second sub-decoders decode divided upper and lower four bits of the 8-bit display data, respectively. In a first mode, the data is for a four gradient display for each of four pixels on each segment electrode. In a second mode, the data is for a two gradient display for each of eight pixels on each segment electrode.

11 Claims, 6 Drawing Sheets

DISPLAY DRIVER APPARATUS, AND ELECTRO-OPTICAL DEVICE AND ELECTRONIC EQUIPMENT USING THE SAME

BACKGROUND OF THE INVENTION

1. Field of the Invention

The present invention relates to a display driver apparatus, and an electro-optical device and an electronic equipment using the same.

2. Description of the Related Art

In recent years, display driver apparatuses have been implemented in hand-held telephones, hand-held data terminals and gaming apparatuses to perform screen display control. However, because the required display gradient between and among such devices varies, depending on the purpose or application of use, different display driver apparatuses having different gradient displays are individually manufactured for a particular purpose and application. Less expensive display drivers are incorporated into lower priced devices. Others are employed to provide lower power consumption. Still others offer higher image quality.

Thus, in recent years, different types of display driver apparatuses with different specifications regarding the number of gradients and display capacity have been required in order to meet end users' requirements or to accommodate sales strategies of electronic equipment manufacturers. As a result, parts management has become complex, because different parts may have to be prepared for each of the display driver apparatuses with different specifications. There are additional complications as well. For example, when a circuit needs to be implemented to reduce power consumption of a display driver apparatus, the design and manufacturing processes have to be revised for individual display driver apparatuses of different gradients.

OBJECTS OF THE INVENTION

Therefore, it is an object of the present invention to provide a display driver apparatus with increased general applicability, in which the number of display gradients available can be selectively changed.

It is a further object of this invention to provide an electro-optical device and electronic device that employs such an improved display driver apparatus.

SUMMARY OF THE INVENTION

In accordance with one aspect of the present invention, a display driver apparatus for driving a display is provided. The display comprises a plurality of pixels, each of which is located at a respective one of a plurality of intersections formed by one of a plurality of common electrodes and one of a plurality of segment electrodes, wherein an orientation state of electro-optical material of each pixel is controlled by a voltage applied to it. The display driver apparatus is comprises a common electrode drive device that supplies a scanning signal for simultaneously selecting L common electrodes, where L is a natural number and $L \geqq 2$; a segment electrode drive device that supplies a data signal to each of the plurality of segment electrodes; a storage medium from which N-bit display data are simultaneously read out for each of the plurality of segment electrodes; and a decoder having a plurality of sub-decoders and that divides the N-bit display data simultaneously read out from the storage medium into (N/L)-bit data units, decodes the (N/L)-bit data units, and outputs a voltage to be applied to each of the segment electrodes. In accordance with the invention, in a first mode, the N-bit display data provides $2^A$ display gradients for each of L pixels on each of the segment electrodes, where $A=(N/L) \geqq 2$, and an output voltage is output from a selected one of the sub-decoders in each of A divided periods of one horizontal scanning period, and in a second mode, the N-bit display data provides $2^B$ display gradients for each of $n \times L$ pixels on each of the segment electrodes, where $1 \leqq B=A/n$ and $n \geqq 2$, and an output voltage is output from a selected one of the sub-decoders every n horizontal scanning periods.

In the manner described above, by selecting between the first mode and the second mode, each of the pixels can be driven to display $2^A$ gradients or $2^B$ gradients. The apparatus is able to be switched from one mode to the other. Preferably, a display driver apparatus is capable of being switched between a two-gradient display mode and a four-gradient display mode.

The display driver apparatus may include a terminal that selects one of the first mode and the second mode. Depending on the state of connection to the terminal, the display driver apparatus can be operated in one of the first mode and the second mode.

Instead of the above, an interface circuit for inputting display data from an external source may be provided, such that a mode selection signal for selecting one of the first mode and the second mode is input through the interface circuit. By doing so, one display driver apparatus can be operated by selectively switching to the first mode or the second mode based on the mode selection signal.

Also, the display driver apparatus in accordance with the present invention has a variety of applications, and as such, may be embodied in any of a variety of electro-optical devices or electronic devices.

In accordance with another aspect of the invention, a method for driving a display is provided. The display comprises a plurality of pixels, each of which is located at a respective one of a plurality of intersections formed between one of a plurality of common electrodes and one of a plurality of segment electrodes, wherein an orientation state of an electro-optical material of each pixel is controlled by a voltage applied to it. The display driving method comprising the steps of a common electrode drive device that supplies a scanning signal for simultaneously selecting L common electrodes, where L is a natural number and $L \geqq 2$; supplying a data signal to each of the plurality of segment electrodes; simultaneously reading N-bit display data for each of the plurality of segment electrodes; and dividing each read N-bit display data into (N/L)-bit units, decoding the (N/L)-bit data units, and output a voltage to be applied to each of the segment electrodes. In a first mode, the N-bit display data provides $2^A$ display gradients for each of L pixels on each of the segment electrodes, where $A=(N/L) \geqq 2$, and an output voltage is output in each of A divided periods of one horizontal scanning period, and in a second mode, the N-bit display data provides $2^B$ display gradients for each of $n \times L$ pixels on each of the segment electrodes, where $1 \leqq B=A/n$ and $n \geqq 2$, and an output voltage is output every n horizontal scanning periods.

DESCRIPTION OF THE PREFERRED EMBODIMENTS

Embodiments of the present invention are described below in detail with reference to the accompanying drawings.

Display Driver Apparatus

Figure 1:
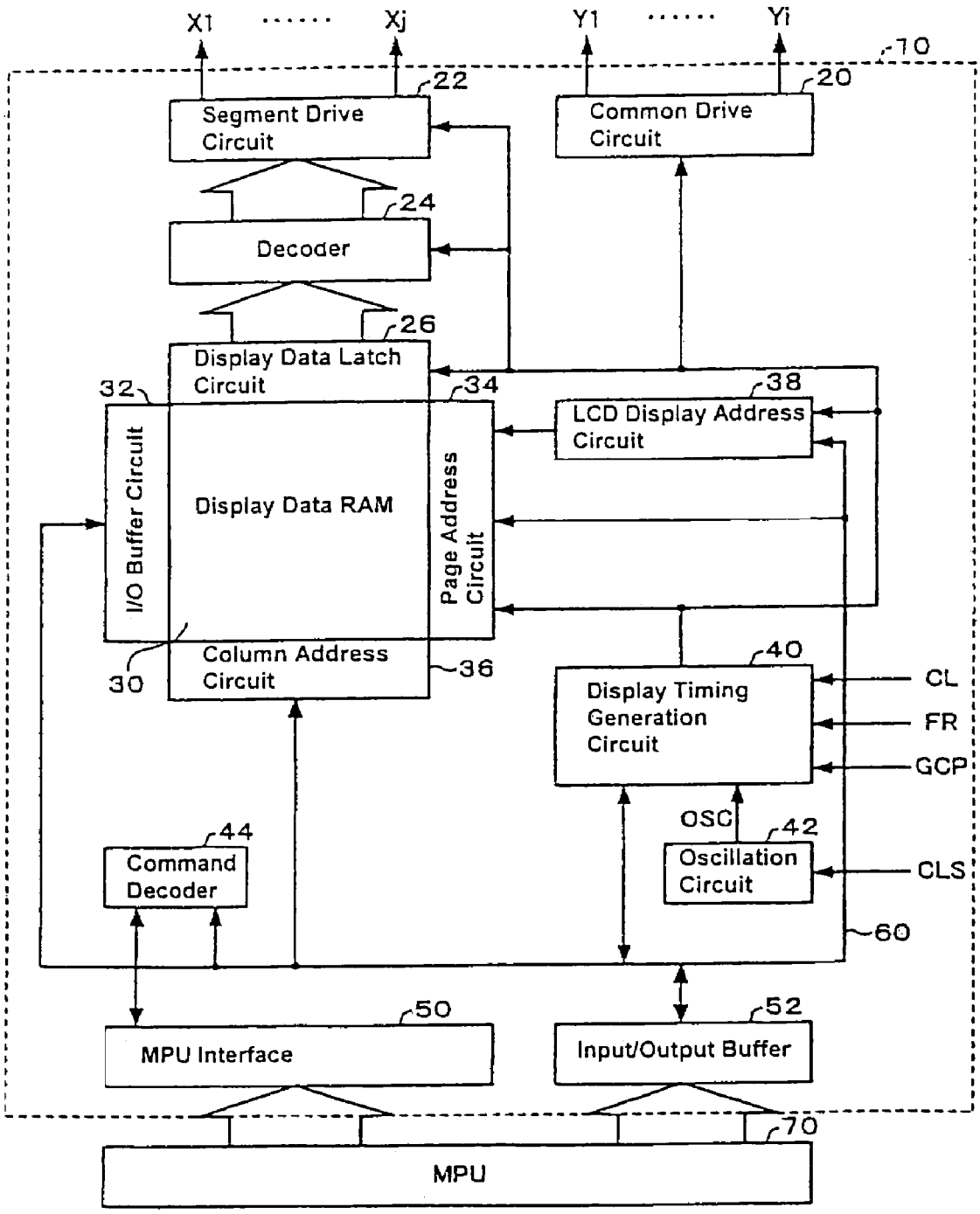
FIG. 1 is a functional block diagram showing the general structure of a liquid crystal device having a display driver apparatus mounted therein in accordance with an embodiment of the present invention.

A display driver apparatus 10 shown in FIG. 1, which is formed from an IC chip, has components for driving a liquid crystal device (LCD), such as, a common drive circuit 20, a segment drive circuit 22, a decoder 24, a display data latch circuit 26, a display data RAM 30, an input/output (I/O) buffer circuit 32, a page address circuit 34, a column address circuit 36, an LCD display address circuit 38, a display timing generation circuit 40, an oscillation circuit 42, an MPU interface circuit 50 and an input/output buffer 52.

The MPU interface circuit 50 has multiple input terminals for inputting various signals from an external MPU 70. The input terminals provided include a chip select terminal, a data recognition terminal, a data bus latch terminal, a data taking terminal, a reset terminal and a parallel-serial input switching terminal.

A signal that determines as to whether the display driver apparatus 10 is in an active state is supplied to the chip select terminal. A signal that recognizes as to whether data supplied from the MPU 70 is command data or display data is supplied to the data recognition terminal. When a signal is supplied to the data bus latch terminal, a data bus 60 is latched, and a data signal is output to the data bus 60. When a signal is supplied to the data taking terminal, a data signal on the data bus 60 is taken into the display driver apparatus. When a signal is supplied to the reset terminal, a default value is set. A signal that switches either of a parallel input or a serial input is input in the input switching terminal.

The input/output buffer 52 is provided with input/output terminals (for example, terminals D0~D7 for N=8 bits). Command data and display data that are processed by the external MPU 70 are supplied to the display driver apparatus through the input/output terminals D0~D7. It is noted that the bit number N is not limited to one byte (8 bits); N includes other bit numbers as well. For example, N may be one word (16 bits) or one long word (32 bits).

One example of an operation of the display driver apparatus 10 caused by a variety of signals supplied to the MPU interface 50 is described below.

When a signal "0" is input in the data recognition terminal, command data is input in the input/output buffer 52. The command data is supplied to the input/output buffer 52 as serial data. Further, after the serial data for N=8 bits is latched at the input/output buffer 52, it is converted to parallel data and supplied to a command decoder 44. Similarly, when a signal "1" is input in the data recognition terminal, display data is input in the input/output buffer 52. The display data is also supplied to the input/output buffer 52 as serial data. Further, after the serial data for 8 bits is latched at the input/output buffer 52, it is converted to parallel data and output in parallel to the data bus 60. The command data that is decoded by the command decoder 44 is used as an operation command for the display timing generation circuit 40, and also used for an address designation respectively by the page address circuit 34 and the column address circuit 36 connected to the display data RAM 30.

It is noted that the page address circuit 34 and the column address circuit 36 perform an address control when the display data RAM 30 is accessed from the external MPU 70.

Meanwhile, the parallel display data (N=8 bits data) that are latched on the data bus 60 are written, via the I/O buffer circuit 32 of the display data RAM 30, in corresponding respective memory cells in the display data RAM 30 according to the page and column addresses designated by the command.

A clock signal CL, a polarity inversion signal FR and a gradient control signal GCP are supplied to the display timing generation circuit 40. The clock signal CL may be generated by the display timing generation circuit 40 based on an output from the oscillation circuit 42 and the gradient control signal GCP. The display timing generation circuit 40 generates various timing signals that are required for display driving by the liquid crystal panel.

Here, the clock signal CL is a signal that becomes a display clock for the liquid crystal panel. The polarity inversion signal FR is a signal that changes the polarity of a voltage that is applied to each of the pixels on the liquid crystal panel at specified time intervals. The gradient control signal GCP is a signal that controls the level of intensity, darkness or brightness (i.e., the gradient) of the display.

Figure 3:
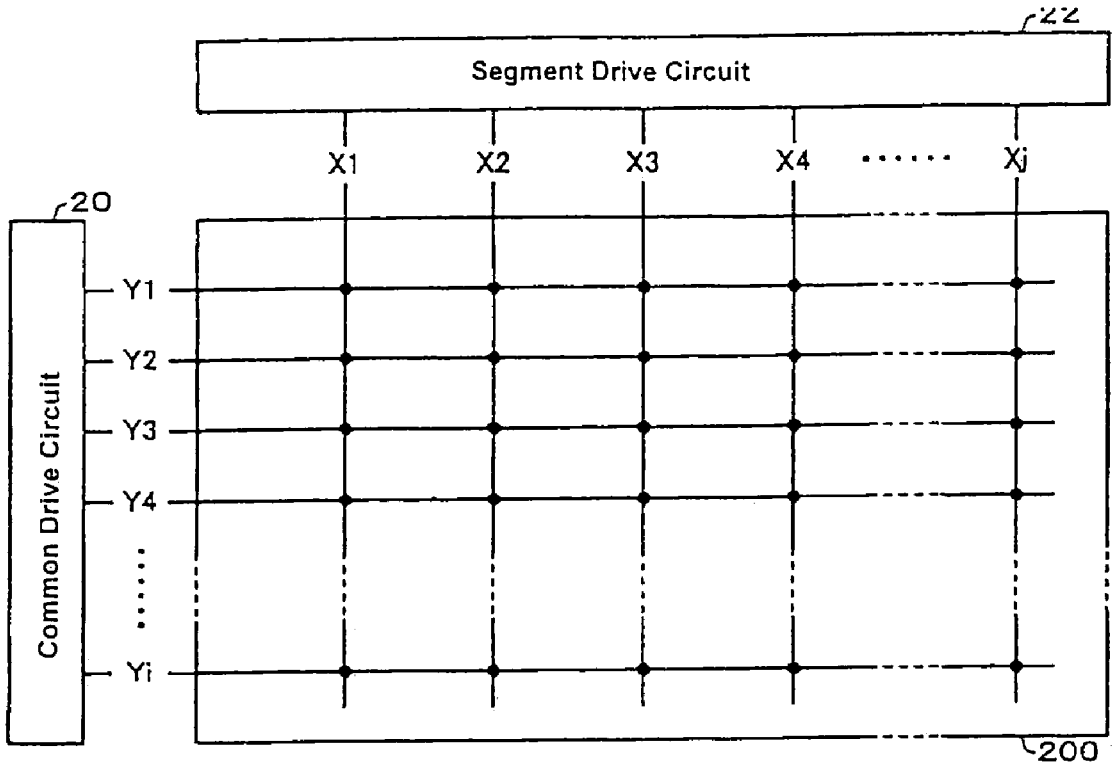
FIG. 3 is a schematic illustration of a liquid crystal panel showing an operation of a display driver apparatus in accordance with the present embodiment.

It is noted that FIG. 3 schematically shows a structure of a liquid crystal panel. Common electrodes Y1~Yi (where i is a natural number) that are driven by the common drive circuit 20, and segment electrodes X1~Xj (where j is a natural number) that are driven by the segment drive circuit 22 are disposed in the liquid crystal panel 200. Also, pixels are formed at locations corresponding to intersections thereof.

The display data RAM 30 includes a total of i×j memory elements (memory cells), whose memory address spaces correspond to the display address spaces of the liquid crystal panel 200. It is noted that, in accordance with the present embodiment, an SRAM (static random access memory) is used as a memory cell. However, a memory apparatus such as a DRAM (dynamic random access memory) may also be used.

Display Space of the Liquid Crystal Display Panel and Address Space of RAM

The display driver apparatus 10 of the present embodiment drives the liquid crystal panel 200 by an MLS (multi-line selection) method. The MLS driving method is a driving method in which L (where L≧2) common electrodes (L=4 in the present embodiment) are simultaneously selected. In a conventional successive line drive method, there is only one selection period in one frame period. As a result, the time interval between one selection period and the next selection period becomes a relatively long single frame period, such that the light transmittance ratio in the liquid crystal decreases with a passage of time, and hence the contrast decreases. On the other hand, using the MLS driving method, L common electrodes are simultaneously driven, such that L selection periods can be provided in one frame period. As a result, the time interval between one selection period and the next selection period is shorter, such that the deterioration of the light transmittance ratio in the liquid crystal is suppressed, and therefore the contrast improves.

Figure 4:
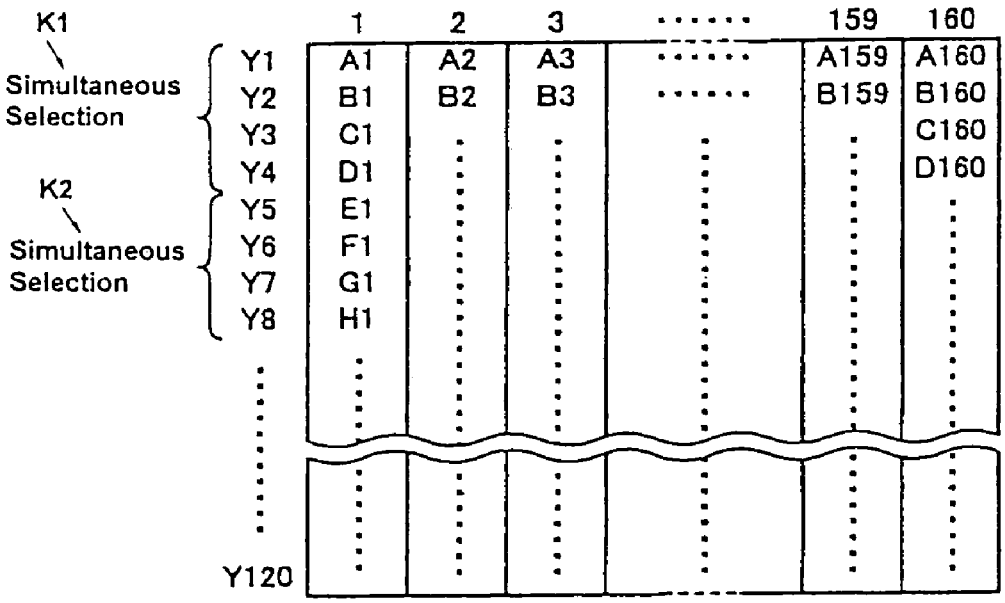
FIG. 4 is a schematic illustration depicting a display memory space of the liquid crystal panel shown in FIG. 3.

FIG. 4 shows a display address space of the liquid crystal panel 200 that has, for example, 160×120 pixels. Display addresses A1~A160 correspond to 160 pixels on the common electrode Y1, and the other lines of display addresses respectively correspond to 160 pixels on each of the other common electrodes.

In the MLS driving method in which, for example, four lines are simultaneously selected. In the present embodiment, common electrodes Y1~Y4 (collectively identified by K1) are simultaneously selected in a first selection period, and common electrodes Y5~Y8 (collectively identified by K2) are simultaneously selected in a second selection period, as shown in FIG. 4. The process continues, with the next group of four common electrodes being selected at each successive selection period. After the common electrodes Y117~Y120 are selected, the operation returns to again select the first group of common electrodes Y1~Y4, and the same operations are repeated three times more during one frame period. It is noted that the number of common electrodes L that are simultaneously selected is not restricted to 4, but may be varied depending on the application or the results desired. The grouping of common electrodes, and the order of selecting the groups can be modified in a variety of ways as well.

Figure 5:
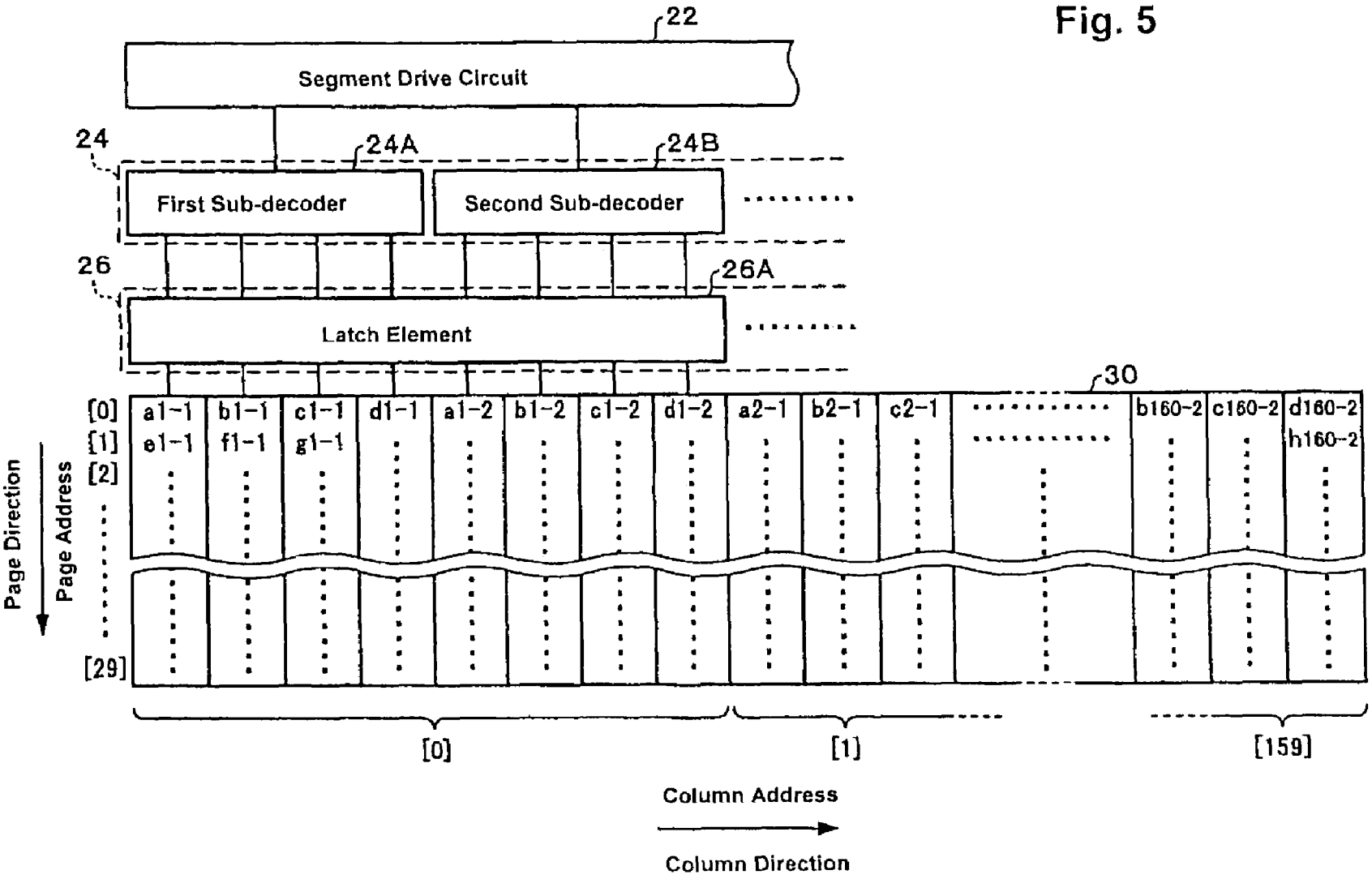
FIG. 5 is a schematic illustration depicting a state in which 2-bit pixel data for a 4-gradient display mode is stored in a memory address space of the display data RAM shown in FIG. 1.
Figure 6:
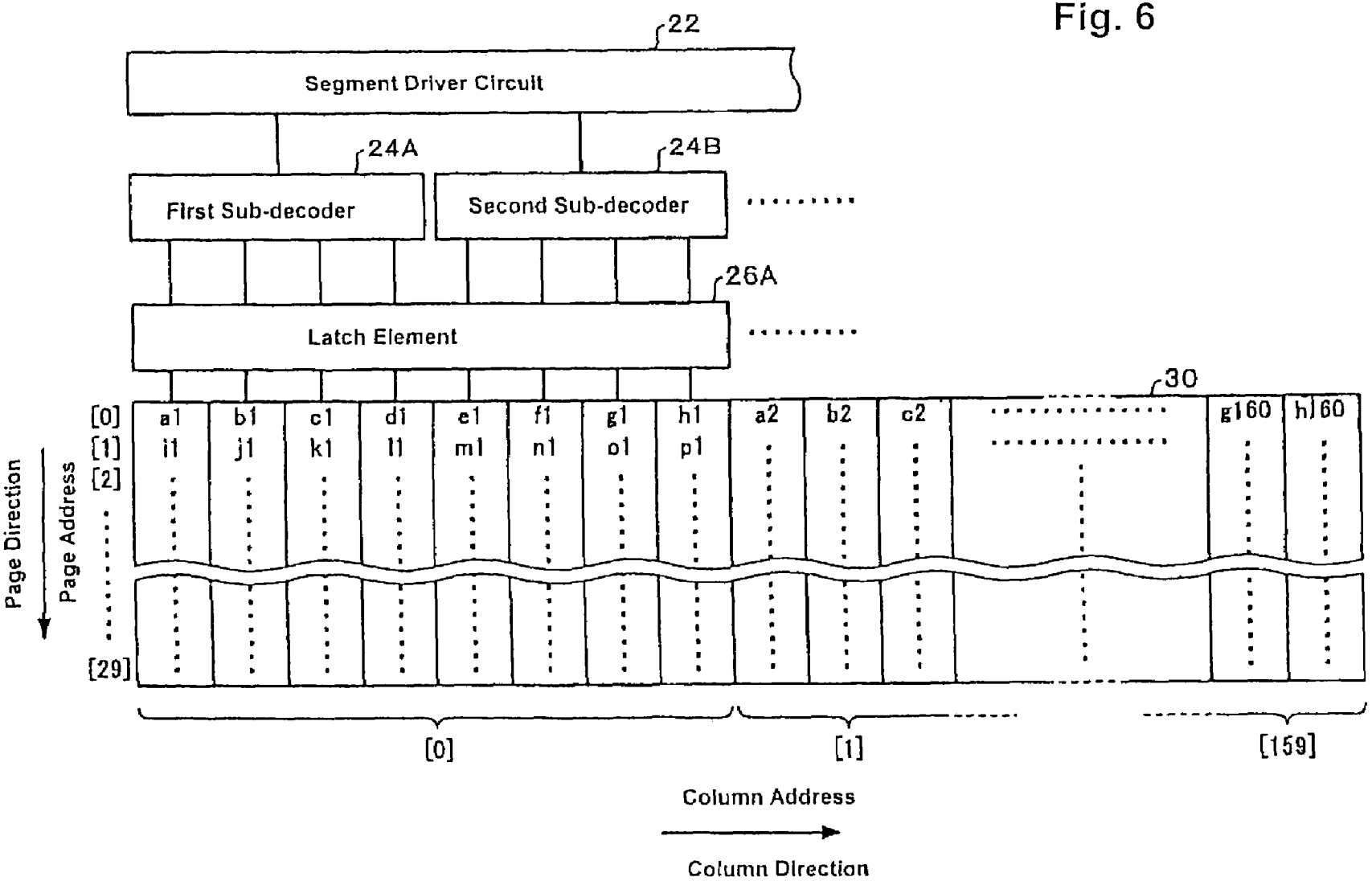
FIG. 6 is a schematic illustration depicting a state in which 1-bit pixel data for a 2-gradient display mode is stored in a memory address space of the display data RAM shown in FIG. 1.

FIG. 5 and FIG. 6 respectively show different embodiments of a memory address space of the display data RAM 30 in the liquid crystal panel 200 that has the display address space shown in FIG. 4. FIG. 5 and FIG. 6 indicate that display data for displays having different numbers of display gradients can be stored in the same memory address space.

FIG. 5 shows a memory address space of the display data RAM 30 when each of the pixels of the liquid crystal panel 200 is driven in four gradients (with 2-bit display data for each pixel). In this case, the display data that corresponds to a particular display address, e.g., A1, shown in FIG. 4 is 2-bit display data (an upper and lower bit, e.g., a1-1 and a1-2) in FIG. 5. Each bit (a1-1~d160-2) on the first line in the memory address space in FIG. 5 is one of a 2-bit pair (a combination of an upper and a lower bit) of the display data. Each 2-bit pair on that line corresponds to 2-bit data of a respective one of the display addresses on the first four lines in FIG. 4. Accordingly, the display data (a1-1~d160-2) on the first word line in the memory address space in FIG. 5 is used only during the first selection period, as indicated by K1 in the display address space shown in FIG. 4. In other words, when N-bit data that is supplied from the MPU is used for $2^A$ gradient display for each of L pixels respectively located at intersections between each segment electrode and L common electrodes that are simultaneously selected, a relation A=N/L is established. In the present embodiment, for 8-bit data (N=8), 4-gradients ($2^A=2^{8/4}=4$) are used for each of the four pixels respectively located at intersections between each segment electrode and the 4 common electrodes that are simultaneously selected.

FIG. 6 shows a memory address space of the display data RAM 30 when each of the pixels of the liquid crystal panel 200 is driven in two gradients (with 1-bit display data for each pixel). In this case, the display data that corresponds to a particular display address, e.g., A1, shown in FIG. 4 is 1-bit display data, e.g., a1, in FIG. 6. Each bit of the display data (a1~h160) on the first line in the memory address space in FIG. 6 corresponds to 1-bit data of a respective one of the display addresses on the first eight lines in FIG. 4. Accordingly, the display data (a1~h160) on the first word line in the memory address space in FIG. 6 is used during both of the first and second selection periods, as indicated by K1 and K2 in the display address space shown in FIG. 4. In other words, when N-bit data that is supplied from the MPU is used for $2^B$ gradient display for each of n×L pixels respectively located at intersections between each segment electrode and n×L common electrodes, a relation B=A/n is established. In the present embodiment, for 8-bit data (N=8) 2-gradients ($2^B=2^{2/2}=2$) are used for each of the eight pixels respectively located at intersections between each segment electrode and the 8 common electrodes that are simultaneously selected.

Among the display data stored in the display data RAM 30, data from memory cells corresponding to the four or eight simultaneously selected common electrodes in the liquid crystal panel 200 are successively read out to the display data latch circuit 26 based on the control by the LCD display address circuit 38. The reading operation can be performed, for example, based on the gradient control signal GCP. The display data latch circuit 26 includes a latch element 26A that latches the simultaneously read out 8-bit data, as shown in FIG. 5 and FIG. 6. The latched display data is then supplied to the decoder 24 based on the clock signal CL that originates from the display timing generation circuit 40. As shown in FIG. 5 and FIG. 6, the decoder 24 includes a first sub-decoder 24A that decodes 4 bits of the 8-bit display data that is latched by the latch element 26A, and a second sub-decoder 24B that decodes the other 4 bits of the latched display data. The display data that is decoded by the decoder 24 is converted by the segment drive circuit 22 to a voltage level required to drive the liquid crystal panel, and that voltage is, in turn, supplied to the segment electrodes X1~Xj. In connection with this operation, groups common electrodes (e.g., 4 or 8 per group) are successively selected by the common drive circuit 20.

Operation in 4-Gradient Display Mode In accordance with the present embodiment, the display driver apparatus 10 performs an MLS driving method in which a plurality of common electrodes are selected and driven in each horizontal scanning period (one selection period) based on the supplied display data and a variety of signals.

In the liquid crystal device driven based on the MLS driving method, one horizontal scanning period (1 H) is divided in accordance with the bit number of the display data, such that a plurality of periods are created. For example, when a $2^A$=4-gradient display is employed, all the gradients can be displayed with 2-bit display data. In this instance, one horizontal scanning period (1 H) is divided into two periods (A=2). When A=3 bits, 8 gradients can be displayed, and one horizontal scanning period is divided into three periods (A=3). The time duration of each of the divided periods may be adjusted (weighted) to achieve a more detailed gradient adjustment.

In an MLS driving method for a liquid crystal device in which four common electrodes are simultaneously selected, a display mode of a display driver apparatus that is capable of a 4-gradient display is switched such that it is used as a display driver apparatus that is capable of a 2-gradient display. This operation is described below with reference to a timing chart in FIG. 2.

Figure 2:
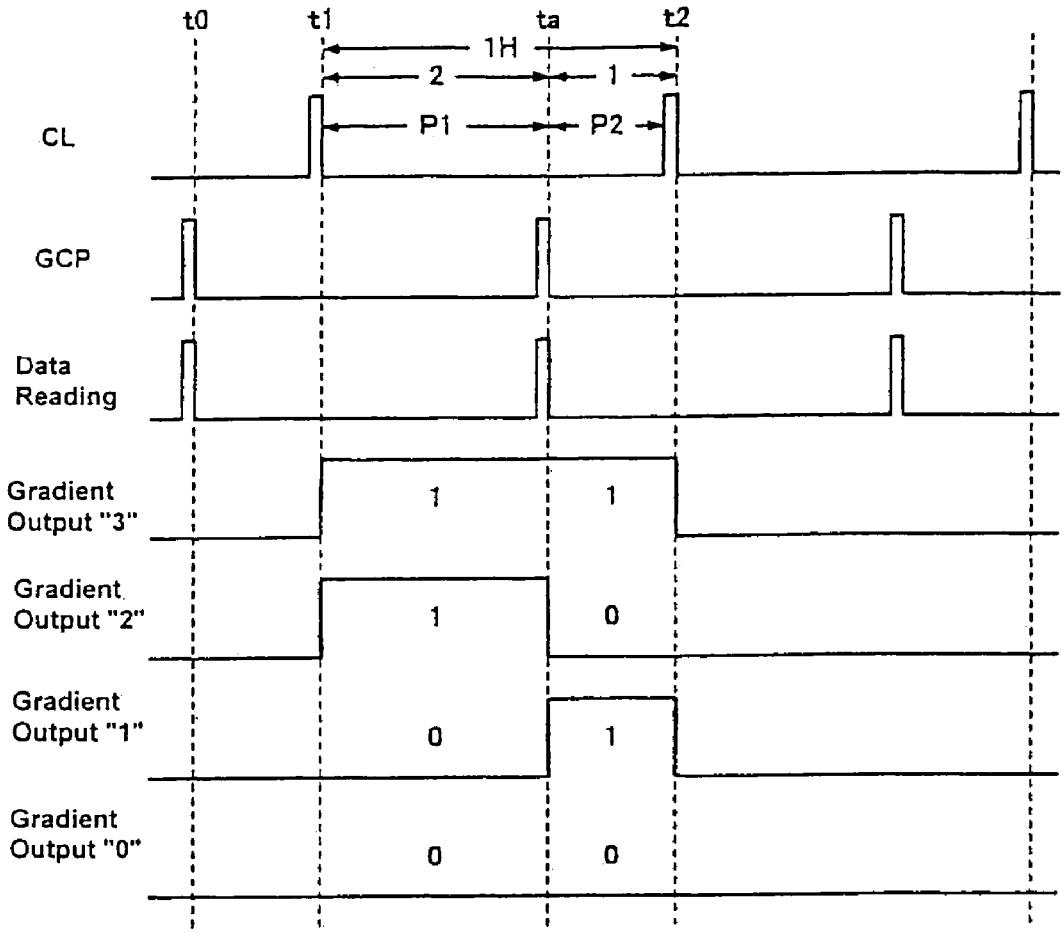
FIG. 2(*a*) shows a timing chart to describe an operation in a 4-gradient display mode, and FIG. 2(*b*) shows a timing chart to describe an operation in a 2-gradient display mode.
Figure 2:
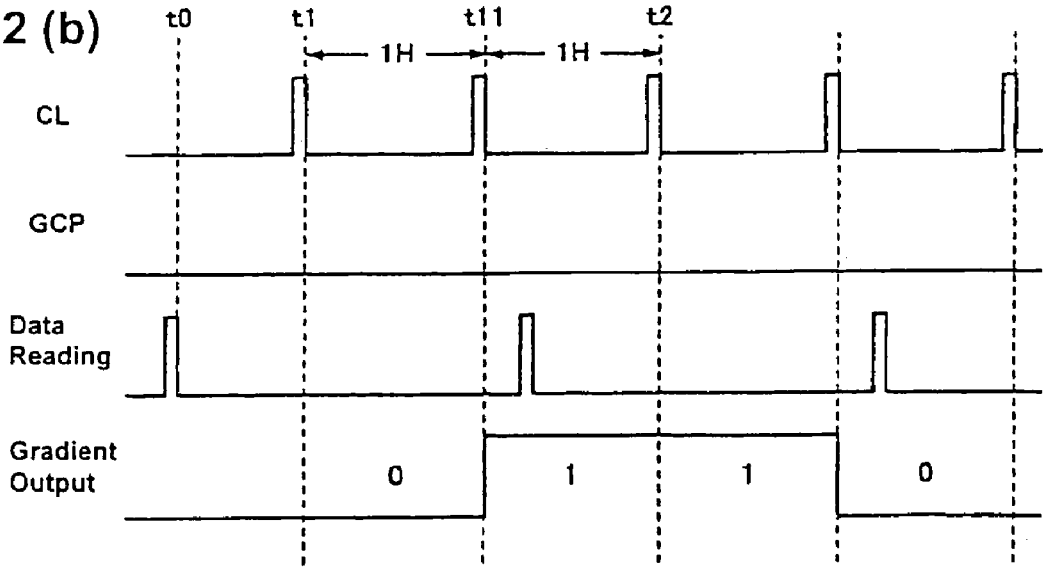

FIG. 2(*a*) shows a timing chart of the display driver apparatus that performs the 4-gradient display before the display mode is switched. In this instance, each pixel is represented by 2-bit display data, in accordance with FIG. 5. In other words, 8-bit display data (a1-1~d1-2) for four pixels, each 2-bit pair representing display data for a respective one of the pixels, are supplied from MPU 70 to the respective eight memory cells at a page address [0] and a column address [0] disposed in the display data RAM 30.

The display data for one word line stored in the display data RAM 30 is read out to the display data latch circuit 26 in accordance with a data reading signal at time t0, and decoded by the decoder 24. It is noted that the timings at which the data reading signal and the gradient control signal GCP are supplied to the liquid crystal device are both set at time t0. However, they can be set at mutually different timings.

When the 4-gradient display control is performed, one horizontal scanning period (1 H), which is the period between successive falling edges of the clock signal CL (i.e., between time t1 and time t2), is divided by the gradient control signal GCP to produce two periods P1 and P2, where, for example, P1/P2=2. Here, P1 represents the period of t1~ta, and P2 represents the period of ta~t2. During the P1 period, an upper bit in the display data for each of the four pixels (data a1-1, b1-1, c1-1 and d1-1 respectively corresponding to the pixels A1, B1, C1 and D1) used, for example, as a gradation value, is decoded by an MLS operation performed by the first sub-decoder 24A, and a driving potential corresponding to the decoded value is output. Similarly, during the P2 period, a lower bit in the display data for each of the four pixels (data a1-2, b1-2, c1-2 and d1-2 respectively corresponding to the pixels A1, B1, C1 and D1) also used, for example, as a gradation value, is decoded by an MLS operation performed by the second sub-decoder 24B, and a driving potential corresponding to the decoded value is output. In this manner, the MLS operations are performed for the upper bits and the lower bits of the display data within one horizontal scanning period (1 H) to generate the driving potentials, and the segment drive circuit 22 selects and supplies a driving potential based thereon. As a result, the effective voltage value that is applied to each of the pixels is controlled, such that a gradient display drive is achieved. For example, in the case of a gradient output "3", an on-voltage is applied during each of the P1 and P2 periods. Conversely, in the case of a gradient output "0", an on-voltage is not applied during each of the P1 and P2 periods. It is noted that, in a normally-white liquid crystal panel, black is recognized in the case of a gradient output "3".

In this manner, voltages that represent specified ones of the gradient outputs "0"~"3" are applied to the pixels corresponding to the four common electrodes in the liquid crystal panel.

It is noted that, in this embodiment, one horizontal scanning period is weighted at a ratio of 2:1 by the gradient control signal GCP. However, the ratio can be appropriately adjusted according to the gradient display condition of the display, for example, a liquid crystal panel.

Operation in 2-Gradient Display Mode

FIG. 2(*b*) shows a timing chart of the display driver apparatus that performs the 2-gradient display after the display mode is switched. In this instance, each pixel is represented by 1-bit display data, in accordance with FIG. 6. In other words, 8-bit display data (a1~h1) for each eight pixels are supplied from MPU 70 to the respective eight memory cells at a page address [0] and a column address [0] disposed in the display data RAM 30. It is noted that, even in this 2-gradient display mode, display data having eight bits, which is the same bit number as that in the case of the 4-gradient display mode, are successively supplied to the display data RAM 30.

At time t0, an address is designated by the LCD display address circuit 38, whereby display data (a1~h160) on the first word line shown in FIG. 6 is read out from the display data RAM 30, and latched on the display data latch circuit 26.

Each of the display data for 2-gradient display is formed from one bit. Based on a read signal at time t0, data corresponding to two horizontal scanning periods (for driving eight lines) of the liquid crystal panel 200 are latched on the display data latch circuit 26, and decoded by the decoder 24. Then, based on a clock signal CL, gradient potentials based on outputs of the decoder 24 are output at t1 from the segment drive circuit 22 during the first selection period. Here, display data a1~d160, corresponding to the common electrodes Y1~Y4 that are simultaneously selected during the first selection period, are decoded by the first sub-decoder 24A of the decoder 24. During the first selection period, based on the decoded values from the first sub-decoder 24A, gradient potentials are output from the segment drive circuit 22.

At the next output timing t11 of the clock signal CL, the first selection period is completed, and a second selection period begins. Accordingly, in the 2-gradient display mode, the length of one horizontal scanning period (one selection period) is half of that in the 4-gradient display mode.

Based on the clock signal CL, gradient potentials based on outputs of the decoder 24 are output at t11 from the segment drive circuit 22 during the second selection period. Here, display data e1~h160 corresponding to the common electrodes Y5~Y8 that are simultaneously selected during the second selection period are decoded by the second sub-decoder 24B of the decoder 24. During the second selection period, based on the decoded values from the second sub-decoder 24B, gradient potentials are output from the segment drive circuit 22.

It is noted that, when the display mode is switched to display two gradients with one bit, one horizontal scanning period (1 H) does not need to be divided by a gradient control signal GCP. Therefore, a gradient control signal GCP need not be supplied.

During the third selection period and each selection period thereafter, a similar operation is conducted each time display data are read in the display data latch circuit 26.

It is noted that, in the 2-gradient display mode, the display data required for one frame is reduced by half compared to that in the 4-gradient display mode, and therefore display data for two frames can be stored in the display data RAM 30.

Also, in the present embodiment, a display driver apparatus 10 that displays a maximum of four gradients is used for displaying two gradients. However, such a display apparatus may also be used to achieve other gradient displays consistent with the invention.

Generation of Timing Signals Corresponding to the Number of Gradations

Figure 7:
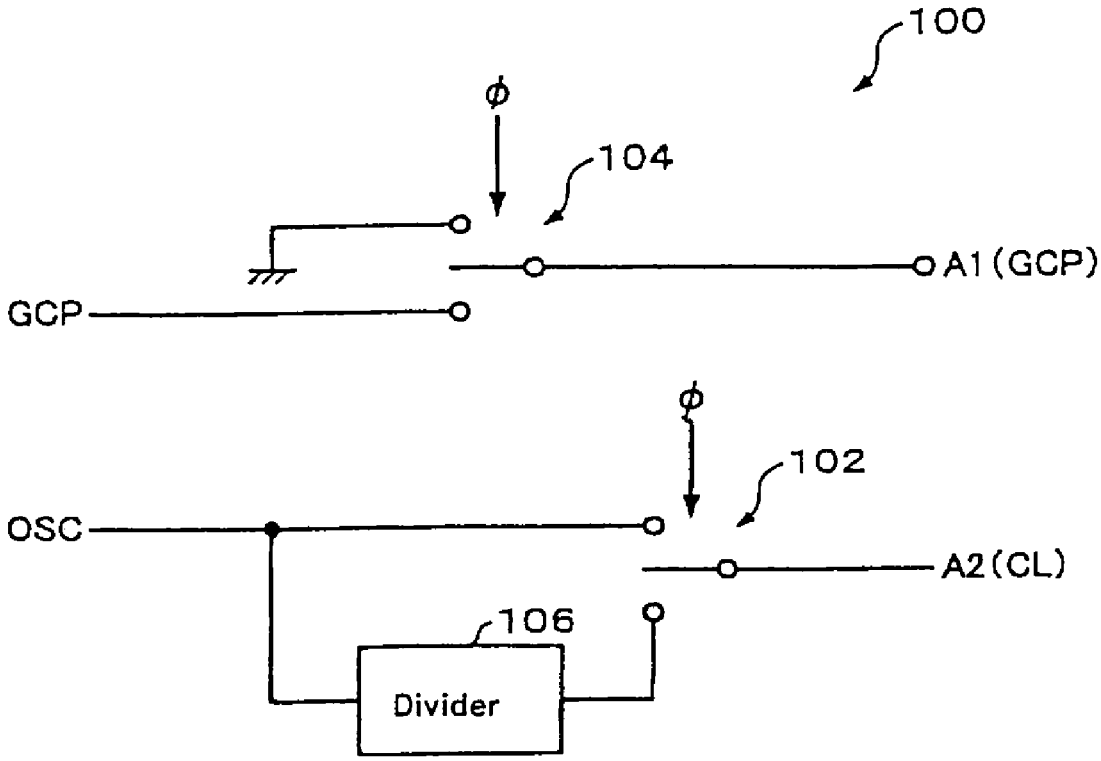
FIG. 7 shows a signal generation circuit in accordance with an embodiment of the present invention.

FIG. 7 shows a signal generation circuit 100 that generates or modifies a variety of timing signals that are used for the 4- and 2-gradient display modes. In the embodiment described above, the signal generation circuit 100 is provided, for example, in the display timing generation circuit 40 to modify a variety of signals.

The signal generation circuit 100 is formed from a divider 106, and switch elements 102 and 104. In the 4-gradient display mode, a signal OSC (having the same frequency as that of the clock signal CL shown in FIG. 2(*a*)) from the oscillation circuit 42 is supplied to a node A2 through the switch element 102 to generate a clock signal CL. Also, the gradient control signal GCP that determines the gradient control position within one horizontal scanning period is generated, in the 4-gradient display mode, at a timing when one horizontal scanning period 1H is divided into a ratio of, for example, 2:1, as shown in FIG. 2(*a*). The gradient control signal GCP is supplied as is to a node A1 through the switch element 104. Accordingly, in the 4-gradient display mode, signals at the nodes A1 and A2 may be used as a gradient control signal GCP and a clock signal CL, respectively.

In the 2-gradient display mode, both of the switch elements 102 and 104 are switched by a signal ϕ to states that are different from those of the 4-gradient display mode. The switch 104 selects a grounding potential, and therefore the gradient control signal GCP from the node A1 is not generated, as shown in FIG. 2 (b). It is noted that, in the 2-gradient display mode, the gradient control signal GCP can be used as a timing signal for reading data from the display data RAM 30, in a similar manner as in the 4-gradient display mode. On the other hand, the signal OSC. from the oscillation circuit 42 is input to the divider 106, and a clock signal CL shown in FIG. 2(*b*) is generated. The clock signal CL is output as is to the node A2 through the switch element 102.

A signal generation circuit 100 structured in this manner is able to modify various signals, such that the gradient switching control of this invention can readily be performed.

Employing the operational techniques in the manner described above, a single display driver apparatus having improved general applicability is achieved. Such an apparatus is able to more use the memory space in the display data RAM provided in the display driver apparatus in different ways to achieve different effects. As a result, a greater variety of display data can be stored in the display data RAM, such that the apparatus can be controlled, for example, to more smoothly perform a scroll display on the liquid crystal panel.

It is noted that the gradient display mode switching can be realized in the following ways. One way is to provide a mode switching terminal as an internal terminal or an external terminal of the display driver apparatus 10. When the switching terminal is provided as an internal terminal, the IC manufacturer can determine a connection state to the switching terminal during the process of manufacturing the IC to select one of the modes. When the switching terminal is provided as an external terminal, the liquid crystal device manufacturer can determine a connection state to the external switching terminal of the display driver apparatus 10 to select one of the modes. Another way is to externally input a mode selection signal to select one of the modes through an interface that externally inputs data such as the MPU interface circuit 50 or the input/output buffer 52. By doing so, multiple gradient display modes on one display panel can be selectively achieved.

While the invention has been described in conjunction with specific embodiments, many further alternatives, modifications, variations and applications will be apparent to those skilled in the art that in light of the foregoing description. For example, the display driver apparatus in accordance with the present invention is not necessarily limited to one that is used for a liquid crystal display; rather, it can be applied to display apparatuses of a variety of different types. Also, the present invention is applicable to a variety of electronic appliances, such as handheld telephones, gaming apparatuses, electronic notebooks, personal computers, word processors, TVs, and car navigation apparatuses. Thus, the invention described herein is intended to embrace all such alternatives, modifications, variations and applications as may fall within the spirit and scope of the appended claims.

What is claimed is:

1. A display driver apparatus for driving a display comprising a plurality of pixels, each of which is located at a respective one of a plurality of intersections formed by an arrangement of a plurality of common electrodes positioned generally parallel to one another and extending in a first direction and one of a plurality of segment electrodes positioned generally parallel to one another and extending in a second direction, wherein an orientation state of an electro-optical material of each pixel is controlled by a voltage applied to it, the display driver apparatus comprising:

a common electrode drive device that supplies a scanning signal for simultaneously selecting L common electrodes, where L is a natural number and $L \geqq 2$;

a segment electrode drive device that supplies a data signal to each of the plurality of segment electrodes;

a single display data RAM from which N-bit display data are simultaneously read out for the L pixels at the respective L intersections that each of the plurality of segment electrodes form with the L common electrodes that are simultaneously selected, the single display data RAM including a memory address space in which the display data is organized according to the groups of L pixels, wherein for each of the L pixels in a particular group, L upper bits, one for each of the L pixels, are stored contiguously in a first sub-group and L lower bits, one for each of the L pixels, are stored contiguously in a second sub-group adjacent to the first sub-group; and a decoder having a plurality of sub-decoders and that divides the N-bit display data simultaneously read out from the single display data RAM into (N/L)-bit data units, decodes the (N/L)-bit data units, and outputs a voltage to be applied to each of the segment electrodes;

wherein in a first mode, the N-bit display data provides $2^A$ display gradients for each of L pixels on each of the segment electrodes, where $A=(N/L) \geqq 2$, and an output voltage is output from a selected one of the sub-decoders in each of A divided periods of one horizontal scanning period, and in a second mode, the N-bit display data provides $2^B$ display gradients for each of n×L pixels on each of the segment electrodes, where $1 \leqq B=A/n$ and $n \geqq 2$, and an output voltage is output from a selected one of the sub-decoders every n horizontal scanning periods.

2. A display driver apparatus according to claim 1, further comprising a terminal that selects one of the first mode or the second mode.

3. A display driver apparatus according to claim 1, further comprising an interface circuit for inputting the N-bit display data from an external source, wherein a mode selection signal for selecting one of the first mode or the second mode is input through the interface circuit.

4. A display driver apparatus according to claim 1, wherein in the first mode the N-bit display data provides four display gradients for each of L pixels on each of the segment electrodes.

5. A display driver apparatus according to claim 4, wherein in the second mode the N-bit display data provides two display gradients for each of 2L pixels on each of the segment electrodes.

6. An electro-optical device comprising a display driver apparatus according to claim 1.

7. An electronic device comprising an electro-optical device according to claim 6.

8. A method for driving a display comprising a plurality of pixels, each of which is located at a respective one of a plurality of intersections formed between one of a plurality of common electrodes and one of a plurality of segment electrodes, wherein an orientation state of an electro-optical material of each pixel is controlled by a voltage applied to it, the display driving method comprising the steps of:

supplying a scanning signal from a common electrode drive device for simultaneously selecting L common electrodes, where L is a natural number and $L \geqq 2$;

supplying a data signal to each of the plurality of segment electrodes;

simultaneously reading single display data RAM N-bit display data for each of the plurality of segment electrodes, the single display data RAM having an address space in which the display data is organized according to the groups of pixels defined by the commonly selected electrodes and respective segment electrodes and bit positions for pixels in a particular group, the display data being further organized such that, for each of L pixels in a particular group, L upper bits, one for each of the L pixels, are stored contiguously in a first sub-group and L lower bits, one for each of the L pixels, are stored contiguously in a second sub-group adjacent to the first sub-group; and dividing each read N-bit display data into (N/L)-bit units, decoding the (N/L)-bit data units, and output a voltage to be applied to each of the segment electrodes;

wherein in a first mode, the N-bit display data provides $2^A$ display gradients for each of L pixels on each of the segment electrodes, where $A=(N/L) \geqq 2$, and an output voltage is output in each of A divided periods of one horizontal scanning period, and in a second mode, the N-bit display data provides $2^B$ display gradients for each of n×L pixels on each of the segment electrodes, where $1 \leqq B=A/n$ and $n \geqq 2$, and an output voltage is output every n horizontal scanning periods.

9. A display driving method according to claim 8, further comprising the steps of inputting the N-bit display data from an external source, and inputting a mode selection signal for selecting one of the first mode or the second mode from an external source.

10. A display driving method according to claim 8, wherein in the first mode the N-bit display data provides four display gradients for each of L pixels on each of the segment electrodes.

11. A display driving method according to claim 10, wherein in the second mode the N-bit display data provides two display gradients for each of 2L pixels on each of the segment electrodes.

* * * * *

UNITED STATES PATENT AND TRADEMARK OFFICE

CERTIFICATE OF CORRECTION

PATENT NO. : 7,084,866 B2
APPLICATION NO. : 10/005494
DATED : August 1, 2006
INVENTOR(S) : Kazuo Kobayashi It is certified that error appears in the above-identified patent and that said Letters Patent is hereby corrected as shown below:

Column 10, line 61, delete “one of”
Column 10, line 66, delete “one of”
Column 11, line 25, insert --from a-- after “reading”

Signed and Sealed this

First Day of May, 2007

JON W. DUDAS
*Director of the United States Patent and Trademark Office*